United States Patent [19]

Handschuch

[11] Patent Number: 4,700,539

[45] Date of Patent: Oct. 20, 1987

[54] OPEN-END SPINNING DEVICE

[75] Inventor: Karl Handschuch, Gaimersheim, Fed. Rep. of Germany

[73] Assignee: Schubert & Salzer, Ingolstadt, Fed. Rep. of Germany

[21] Appl. No.: 880,689

[22] Filed: Jul. 1, 1986

[30] Foreign Application Priority Data

Jul. 6, 1985 [DE] Fed. Rep. of Germany ..... 3524313

[51] Int. Cl.[4] ..... D01H 7/882; D01H 7/885; D01H 1/135

[52] U.S. Cl. ..... 57/401; 47/406; 47/411

[58] Field of Search ..... 57/400, 401, 404, 406, 57/407, 411

[56] References Cited

U.S. PATENT DOCUMENTS

| | | | |
|---|---|---|---|
| 4,441,310 | 4/1984 | Parker et al. | 57/401 |
| 4,502,272 | 3/1985 | Fuchs | 57/401 |
| 4,601,167 | 7/1986 | Fuchs | 57/401 |

FOREIGN PATENT DOCUMENTS

| | | |
|---|---|---|
| 2810184 | 9/1979 | Fed. Rep. of Germany . |
| 3316658 | 1/1985 | Fed. Rep. of Germany . |

*Primary Examiner*—John Petrakes
*Attorney, Agent, or Firm*—Dority & Manning

[57] ABSTRACT

In an open-end spinning device with two friction rollers driven in the same direction, located next to each other and forming a spinning nip, at least one of such friction rollers has a perforated casing which is over-mounted at one end. Such roller further contains a suction insert with a suction orifice connected to a negative pressure (i.e. vacuum) source. The perforated casing is supported on a shaft, one end of which is received and supported in a portion of the suction insert. The suction insert is located within the casing, directly behind it, and has a constant cross-section up to its connection with a suction line. In such manner, a maximum suction cross-section is provided with minimum support requirements.

19 Claims, 4 Drawing Figures

OPEN-END SPINNING DEVICE

BACKGROUND OF THE INVENTION

This invention concerns open-end spinning in general, and in particular a device therefor having two friction rollers operatively associated with one another to form a spinning nip. Such rollers are driven in the same direction during spinning operation. At least one of the rollers is embodied as a suction roller with a perforated casing, over-mounted at one end. A suction insert, received in the suction roller, has a suction slit and is connected to a negative pressure (i.e. vacuum) source.

Friction rollers embodied as suction rollers and equipped with drive shafts which are over-mounted on rolling bearings are known in the art (e.g. German Pat. DE-OS No. 2,810,184). In such a device, a connecting branch of the suction insert, which is received within the casing of the friction rollers, is located on the face of the casing which opposes drive shafts therefor. Thus, feeding through the fiber feeding channel and suction through the suction insert tend to be in the same direction. Bearings for such an arrangement are often complicated, and even so are not sufficiently stable to properly maintain the uniformly narrow distance between the friction rollers which is required for spinning.

One solution proposed to eliminate these disadvantages was to make the suction insert in the form of a shaft, on which are located rolling bearings for the sleeve extending beyond the area of the suction slit (e.g. German Pat. No. DE-OS No. 3,316,658). However, such an arrangement requires that the distance between the perforated sleeve and the suction insert be widened by the width of the bearing headroom. Such distance must then be bridged in turn by an appropriate tubular connecting piece. Increased manufacturing efforts and a friction roller with a greater diameter are required for such an approach, and hence inevitably lead to higher costs. Furthermore, air-flow conditions are adversely affected, which in turn has an adverse effect on spinning conditions.

SUMMARY OF THE INVENTION

The present invention recognizes and addresses such concerns and drawbacks, as well as others. It is a general object of the instant invention to avoid such disadvantages in prior open-end spinning devices of the type described above.

One embodiment directed to achieving this object concerns supporting the casing of a friction roller on a shaft having one of its ends located in a suction insert. The suction insert is received within such casing, in very close proximity thereto, and provided with a constant crosssection all along its longitudinal length up to its connection to a suction line.

It is a further object of this invention to provide an open-end spinning device with suction having maximum cross-section, but requiring only simple supporting means. It is still another object of this invention to keep the diameter of a friction roller (whose only criterium is that a sufficient amount of air be sucked through its perforated casing) as small as possible. While addressing the foregoing objects, it is further desired to hold down manufacturing costs for the roller and for the cost of air consumption. Further objects and advantages flowing from the practice of this invention will be self-evident from the remainder of the present enabling disclosure.

Various objects and advantages of the present invention may be achieved by different features thereof, varying collections of which may comprise a given construction in accordance with this invention.

In one embodiment of this invention, another end of the shaft (as mentioned above) may be over-mounted in a fixed mount (i.e. mounted around or surrounded by a mount).

In another exemplary construction, a suction insert may be over-mounted in a fixed mount and the shaft inserted in the free end of the suction insert on the side opposite to such mount. In such instance, rolling bearings are preferably used for the support of the casing, whereby the shaft may comprise the inner raceway of the rolling bearing, which further includes at least two thrust rings. A pre-finished and easy-to-assemble bearing is thereby obtained by inserting the shaft with such thrust rings into a bearing sleeve.

In accordance with further aspects of this invention, one of the thrust rings of the rolling bearing is preferably located inside the bearing sleeve at such a distance from the other thrust ring thereof that the one of said thrust rings is actually located axially outside the friction roller casing. Such construction improves concentric running of the casing and makes it possible to drive the casing over that portion of the bearing sleeve which emerges from the casing. A further advantage is obtained that the peripheral speed of the casing can be changed as needed by correspondingly sizing the bearing. Another means of changing the casing peripheral speed in accordance with this invention comprises an additional bushing of selected size brought to bear against the bearing sleeve in a drive zone of the friction roller. To ensure straight-line running of a tangential belt in those instances where one is used to drive a friction roller casing, the friction roller can be pushed against such drive belt in order to adapt to (i.e. accommodate) a changed drive diameter of the rolling bearing.

In a further embodiment of an exemplary construction in accordance with this invention, a device is provided with the suction insert supported by its end which is directed away from the above-mentioned shaft. A means to assist in thread joining, making it possible to suction in (i.e. control) a joining thread and to store same, is created by locating the shaft on a side of the roller opposite to the direction of thread draw-off, and by configuring it as a hollow shaft in which a U-shaped suction tube is inserted. The tube is bent towards the spinning nip. In one such construction, the end of the over-mounted suction insert which is on the side opposite to the shaft can be closed by a rotary disk valve extending along the entire interior of the suction insert to the proximity of the shaft.

While various embodiments of devices constructed in accordance with features of this invention may be used, one exemplary embodiment is directed to an open-end spinning device, comprising: a pair of friction rollers operatively associated to define a spinning nip; one of the rollers being provided with a perforated casing so as to embody a suction roller; a suction insert, having a suction orifice therein, disposed within the suction roller and adapted for connection to a suction source; a support shaft, supporting one axial end of the suction roller perforated casing, and terminating in an axial end of said suction insert; whereby the suction insert is located directly behind said perforated casing, and has a constant cross-section along its entire longitudinal axis.

Yet another exemplary embodiment of this invention concerns an open-end spinning device having two friction rollers located next to each other, forming a spinning nip and driven in the same direction, at least one of which is equipped with a perforated casing to define a suction roller over-mounted at one end and containing a suction insert with a suction orifice connected to a suction source, said device further including: a shaft for supporting the casing, one end of the shaft being set into the suction insert, whereby the suction insert is received within the casing at close intervals thereto, and has an interior cross-section remaining constant up to the connection thereof with the suction source.

Still another embodiment of the present invention includes improved suction structure for an open-end spinning device of the type including a pair of rotatable friction rollers defining a spinning nip, one of said rollers having a perforated casing to define a suction roller with a suction insert received therein and connected to a vacuum source adjacent one of its axial ends; the structure comprising: a shaft for supporting the casing, with one end of the shaft terminating in an axial end of the suction insert opposite from the one axial end thereof connected to a vacuum source; whereby the suction insert is provided with a maximum suction cross-section over its entire axial length, from the shaft termination to said vacuum source connection thereof, with minimum support structure required therefor.

BRIEF DESCRIPTION OF THE DRAWINGS

A full, enabling disclosure of exemplary, presently preferred embodiments of the present invention, including the best mode thereof, is set forth below in the following specification, with reference to the appended figures, in which.

DETAILED DESCRIPTION OF THE PREFERRED EMBODIMENT

Figure 1:
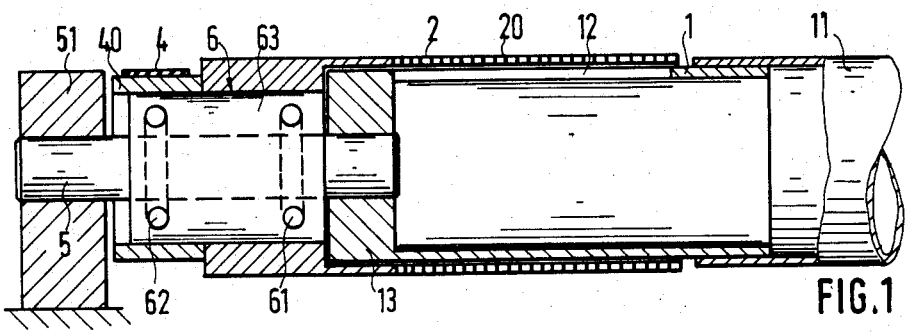
FIG. 1 illustrates a longitudinal section through a friction roller and associated structure according to one exemplary embodiment of the present invention.

Referring to FIG. 1, a cylindrical suction insert 1 is connected to a negative pressure source (not shown) via a suction line 11. Suction insert 1 is disposed inside the casing 2 of a friction roller embodied in the illustration as a suction roller. Casing 2 has a plurality of perforations 20 about its periphery, and a suction slit 12 for operative association with a spinning nip (defined between it and an adjacent friction roller in a known manner). The diameter of suction insert 1 is made just sufficiently smaller than that of casing 2 so as to permit suction insert 1 to be located directly behind such casing while being separated from same by only a narrow gap. Suction insert 1 has a constant cross section over its entire length, which cross section preferably continues also into suction line 11 up to the aforementioned negative pressure (i.e. vacuum) source.

Figure 4:
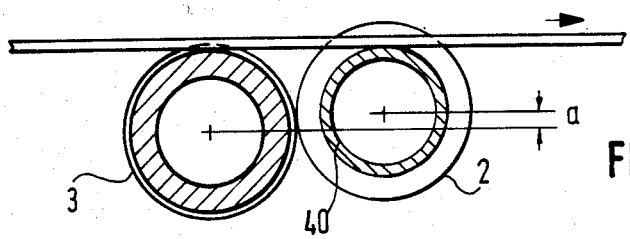
FIG. 4 shows an axial cross-section of two radial friction rollers driven by a tangential belt, with their centers offset by a distance "a".

The above-referenced spinning nip is formed by casing 2 and by a second friction roller. As illustrated in FIG. 4, such second roller 3 is in parallel and in close proximity with first roller 2. Second friction roller 3 can also be embodied as a suction roller as roller 2, or it can be equipped with a closed casing as in the embodiment thereof shown by FIG. 4. Both friction rollers 2 and 3 are typically driven in the same direction, for example by means of a tangential belt 4.

That portion of casing 2 which extends as a nonperforated portion over suction insert 1 is supported in an over-mounted relationship on shaft 5. Shaft 5 has one of its ends restrained in a fixed mount 51. The other end of shaft 5 fits precisely into a bore defined by a floor 13 of suction insert 1. Floor 13 is provided on an end of suction insert 1 opposite to the end thereof associated with the connection to suction line 11. Floor 13 can form an integral part of suction insert 1, or it can alternately comprise a circular member pressed into the end of a tube defining suction insert 1.

Support of casing 2 on shaft 5 is preferably effected by means of a rolling bearing, but can also be suitably effected with a friction bearing. FIG. 1 shows a rolling bearing 6 used for supporting casing 2. Such bearing includes at least two thrust rings 61 and 62 which are located on shaft 5 at an axial distance from each other, and which are inserted together with such shaft in a bearing sleeve 62. Shaft 5 doubles as an inner raceway for bearing 6. Such overall construction provides a compact and easy to handle pre-built bearing unit. Furthermore, casing 2 can be pressed easily, quickly, and firmly onto bearing sleeve 63 so as not to slip relative thereto.

Further illustrated in FIG. 1, second thrust ring 62 of rolling bearing 6 is suitably kept at a given axial distance from first thrust ring 61 such that it is disposed axially outside casing 2. Bearing sleeve 63 extends correspondingly outside casing 2. Such arrangement improves concentric running of casing 2 due to the increased distance between bearing thrust rings. Furthermore, structure is provided to permit the driving of casing 2 by means of a belt, preferably such as tangential belt 4, over the portion of bearing sleeve 63 which extends out beyond casing 2. In such manner, contact pressure of belt 4 is transferred directly to bearing 6, without any breakdown torque.

In addition to the foregoing advantages and improvements flowing from practice of the present invention, the peripheral speed of casing 2 can be changed as needed by correspondingly sizing rolling bearing 6. Such a change can alternatively, or further, be made by means of an additional bushing 40 (i.e. bushing means) brought to bear against bearing sleeve 63 in its drive zone. Different sized bushings 40, of course, permit different changes to such peripheral speed of casing 2.

In order to ensure straight running of such tangential belt 4 when the bearing diameter is thus changed in the drive area (or driving zone), friction roller 2 is supported so that it can be controllably moved up against said tangential belt 4. This is represented in FIG. 4 by the different axial planes of the two friction rollers 2 and 3. The offset "a" of such two different axial planes is made possible because shaft 5 resides detachably in an oblong opening in mount 51 (not shown), or it may at least be pivotably supported over a turning point to permit such adaptation.

Figure 2:
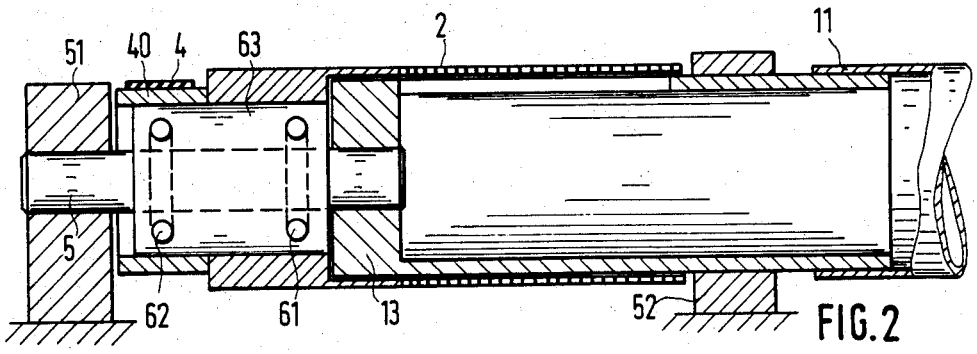
FIG. 2 illustrates a longitudinal section of the friction roller embodiment of FIG. 1, with additional support for the suction insert thereof.

The embodiment of FIG. 2, a further exemplary construction in accordance with various features of the present invention, differs from that shown in FIG. 1 in that suction insert 1 has additional support comprising fixed mount 52 in the area between the free end of over-mounted casing 2 and the end of insert 1 connected to suction line 11. Of course, suction insert 1 does not rotate with roller 2; hence, the relationship between insert 1 and support 52 can be an interference fit or similar close fitting arrangement for suitably holding insert 1 in a desired disposition relative roller 2. Remaining features of FIG. 2 need not be separately discussed since they are substantially explained above with reference to earlier figures.

Figure 3:
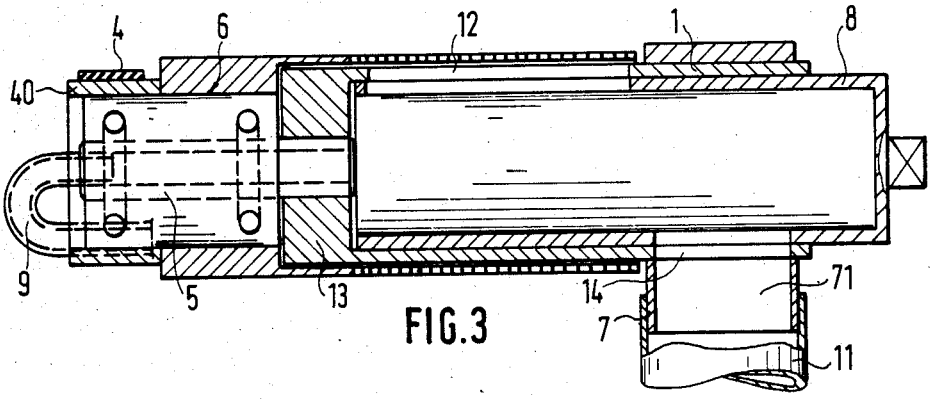
FIG. 3 illustrates a longitudinal section through a friction roller and associated structure constructed in accordance with another embodiment of this invention.

In the further exemplary embodiment shown in FIG. 3, cylindrical suction insert 1 is over-mounted in a fixed mount 7, in place of mount 52 of FIG. 2. Mount 7 also serves to define an integral suction airstream channel 71 through which the connection to a conventional suction air source (not shown) is established by means of suction line 11. An air passage orifice 14 is formed in the periphery of suction insert 1 to further establish the connection between suction air channel 71 and the interior of suction insert 1. In common with the previous embodiments of this invention, suction insert 1 is located inside casing 2 (directly behind it), and has a constant cross-section over its entire length. Suction air channel 71, and also preferably suction line 11, have cross-sectional sizes equal to that of suction insert 1.

Shaft 5 which supports rolling bearing 6 (and which doubles as the inner raceway of such roller bearing) is pressed into the bore defined in floor 13 of suction insert 1, at the end of suction insert 1 which is opposite to mount 7. As in earlier embodiments, casing 2 may be simply pressed upon bearing sleeve 63 of the prefabricated bearing, and driven by means of tangential belt 4 in the axial portion (i.e. drive zone) of bearing sleeve 63 not covered by casing 2.

The open end of suction insert 1 which opposes shaft 5 may be sealed by a closure 8 or the like. Closure 8 substantially takes the place of suction line 11 (FIGS. 1 and 2) in sealing such particular axial end of suction insert 1, and generally comprises a rotary disk valve which extends from such axial end of insert 1 along the interior thereof up to the proximity of shaft 5.

The type of bearing presently disclosed makes it possible to activate this closure 8 from the front without difficulty. Rotary closure has several peripheral openings which may simultaneously be brought into alignment with suction orifice 12 and air passage orifice 14 (which is the disposition thereof illustrated in present FIG. 3). Further, closure 8 may be alternatively actuated so that a selected one of orifices 12 and 14 are opened, closed, or partially opened and closed. Thus, by means of such structural features of closure 8, suction orifice 12 and/or air admission orifice 14 can be opened or closed as needed by controlled rotation of closure 8 to selectively bring about the illustrated alignment of FIG. 3.

As a further feature of this invention, since shaft 5 is located on the side (i.e. axial end) of friction roller 2 opposite to the conventional direction of thread draw-off (not illustrated), it is possible to make the shaft hollow. Then, a U-shaped suction tube 9 may be inserted into hollow shaft 5, which tube 9 is bent in the direction of the conventional spinning nip referenced above, so that air can be sucked through suction tube 9. Such configuration makes it possible to aspire (i.e. suck in or bring in) a joining thread brought in from a direction opposite to the draw-off direction into the range of the spinning nip, and to then store such thread until the spinning process begins. Such aspiration of joining threads is preferably carried out whenever closure 8 is in such a position that suction slit 12 is closed (i.e. blocked) but air admission orifice 14 is open.

Numerous modifications and variations of the disclosed features of this invention, as well as equivalent substitutes therefor and equivalent operative reversals thereof, will be apparent to those of ordinary skill in the art. All such modifications and substitutions form features and aspects of the present invention, as surely do advantages which flow from the presently disclosed structure, but are not described herewith in detail.

For example, it is possible to use a roller with a closed casing (instead of perforated) and which is otherwise supported as discussed above in order to create substantially similar conditions. As further example, alternative bearings, fixed mounts, bushings, drive systems, closures, and the like beyond those embodiments specifically disclosed are included features of this invention.

The foregoing disclosure includes language of description and example only, directed to presently preferred exemplary embodiments of this invention, and not word of limitation, which are found only in the appended claims.

What is claimed is:

1. An open-end spinning device, comprising:

a pair of friction rollers operatively associated to define a spinning nip;

at least one of said rollers being provided with a perforated casing so as to embody a suction roller;

a suction insert, having a suction orifice therein, disposed within said suction roller and adapted for connection to a suction source; and a support shaft with a rotatable bearing received about a longitudinal portion thereof, said roller bearing supporting one axial end of said suction roller perforated casing with the other axial end of said casing being unsupported, and said shaft terminating in one axial end of said suction insert; and wherein said suction insert is located directly behind said perforated casing, and has a constant cross-section along its entire longitudinal axis so as to provide a uniformly maximized suction cross-section with the smallest possible diameter suction roller perforated casing.

2. A device as in claim 1, wherein the other axial end of said support shaft is fixedly mounted against relative rotation with respect to said open-end spinning device.

3. A device as in claim 2, further including additional support for said suction insert near an axial end thereof opposite that axial end where said support shaft terminates therein, said additional support being fixedly mounted against rotation relative said open-end spinning device so that said suction insert does not turn relative said device.

4. A device as in claim 1, wherein said rotatable bearing comprises a roller bearing interposed between said shaft and said suction roller, with said shaft comprising an inner raceway of said roller bearing; said roller bearing further including at least two bearing races disposed a predetermined axial distance from one another.

5. A device as in claim 4, wherein said roller bearing further includes a bearing sleeve with said two bearing races received therein, said sleeve being disposed in such manner between said suction roller and said shaft that one of said bearing races is disposed axially within said suction roller, and the other of said bearing races is disposed axially outside said

6. A device as in claim 5, wherein a portion of said bearing sleeve is disposed axially outside said suction roller so as to define a drive zone adapted for receipt of a drive belt therearound for rotating said suction roller.

7. A device as in claim 6, further comprising bushing means, operatively associated with said drive zone, for selectively varying the rotational speed of said suction roller by being adapted to change the drive relationship between said bearing sleeve and a drive belt associated therewith.

8. A device as in claim 1, wherein:

one axial end of said suction roller is adapted to be in a direction of thread draw-off of said device;

said shaft is hollow, and is situated opposite such adapted axial end of said suction roller; and said device further includes a U-shaped suction tube received in said hollow shaft, and bent downwards towards said spinning nip of said device.

9. A device as in claim 1, further comprising a rotary disk valve received within said suction insert, and defining a closure for the axial end thereof opposing that axial end where said support shaft terminates therein; said rotary disk valve extending within said suction insert up to the proximity of said shaft terminated therein, and being actuable for selectively closing said suction orifice thereof, and an air passage orifice associated with a suction source adapted for peripheral connection to said suction insert.

10. In an open-end spinning device having two friction rollers located next to each other, forming a spinning nip and driven in the same direction, at least one of which is equipped with a perforated casing to define a suction roller over-mounted at one end and containing a suction insert with a suction orifice connected to a suction source, said device further including:

a shaft for supporting one axial end of said casing, the other axial end of which is free, one end of said shaft being set into said suction insert, whereby said suction insert is received within said casing at close intervals thereto, and has an interior cross-section remaining constant up to said connection thereof with said suction source.

11. A device as in claim 10, further comprising a fixed mount for receiving and supporting the other end of said shaft not set in said suction insert.

12. A device as in claim 10, further comprising a fixed mount for receiving and supporting said suction insert adjacent an end thereof opposite that where said shaft is set therein.

13. A device as in claim 17, wherein one axial end of said casing is adapted to be in a direction of thread draw-off of said device, and said shaft is opposite to such axial end and is hollow for receipt of a U-shaped suction tube, which tube is bent towards said spinning nip and provided with suction for controllably aspiring and storing a joining thread.

14. A device as in claim 12, further comprising a closure, on the end of said suction insert opposite said shaft, for closing such end, said closure comprising a rotary disk valve received within said insert and extending up to the proximity of said shaft.

15. A device as in claim 10, further comprising a roller bearing provided between said shaft and said casing, with said shaft comprising the inner raceway thereof; said bearing further including at least two bearing races located at an axial distance from each other.

16. A device as in claim 15, wherein said bearing races are located inside a bearing sleeve, with one of said bearing races being received within said sleeve at such a distance from the other of said bearing races so as to be disposed axially outside said casing.

17. A device as in claim 16, wherein a portion of said bearing sleeve extends axially outside said casing so as to constitute a drive area thereof adapted for being rotatably driven by a drive belt.

18. A device as in claim 17, wherein said device further includes bushing means for variably an controllably displacing said casing in relation to a drive belt so as to adapt to changing drive diameters of said rolling bearing.

19. An improved suction structure for an open-end spinning device of the type including a pair of rotatable friction rollers defining a spinning nip, one of said roller having a perforated casing to define a suction roller with a suction insert received therein and connected to a vacuum source adjacent one of its axial ends, said structure comprising:

a shaft for providing cantilevered support of said casing, with one end of said shaft terminating in an axial end of said suction insert opposite from said one axial end thereof connected to a vacuum source;

whereby said suction insert is provided with a maximum suction cross-section over its entire axial length, from said shaft termination to said vacuum source connection thereof, with minimum support structure required therefor.

* * * * *